US010775141B1

(12) United States Patent
Moy et al.

(10) Patent No.: US 10,775,141 B1
(45) Date of Patent: Sep. 15, 2020

(54) EXOSKELETON CARTRIDGE CASE DESIGN FOR LW 30MM AMMUNITION

(71) Applicant: U.S. Government as Represented by the Secretary of the Army, Picatinny Arsenal, Dover, NJ (US)

(72) Inventors: Leon Moy, Verona, NJ (US); Viral Panchal, Parlin, NJ (US); Pasquale Carlucci, Fairlawn, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/556,699

(22) Filed: Aug. 30, 2019

(51) Int. Cl.
*F42B 39/20* (2006.01)
*F42B 12/20* (2006.01)

(52) U.S. Cl.
CPC ..... *F42B 12/207* (2013.01); *F42B 39/20* (2013.01)

(58) Field of Classification Search
CPC .. F42B 5/285; F42B 5/29; F42B 5/307; F42B 39/20; F42B 12/207
See application file for complete search history.

(56) References Cited

U.S. PATENT DOCUMENTS 5,035,182 A * 7/1991 Purcell ..... F42B 39/20 102/293
8,925,463 B1 * 1/2015 Sullivan ..... F42B 39/20 102/439
2005/0193917 A1 * 9/2005 Friedlander, III ..... F02K 9/38 102/481

FOREIGN PATENT DOCUMENTS

GB 1341728 * 12/1973

* cited by examiner

*Primary Examiner* — Stephen Johnson
(74) *Attorney, Agent, or Firm* — John P. DiScala

(57) ABSTRACT

An insensitive munition (IM) feature for a lightweight LW 30 MM ammunition projectile utilizing combustible vent plugs for the projectile, which plugs feature an exclusively nitrocellulose material sheet fused to a metal foil sheet, to plug vent holes in the projectile.

4 Claims, 6 Drawing Sheets

EXOSKELETON CARTRIDGE CASE DESIGN FOR LW 30MM AMMUNITION

U.S. GOVERNMENT INTEREST

The inventions described herein may be made, used, or licensed by or for the U.S. Government for U.S. Government purposes.

BACKGROUND OF INVENTION

The present invention relates to the field of Insensitive Munitions (IM), and, more particularly, to a new and simplified mechanism for reducing the vulnerability of propellant loaded cartridges from unplanned thermal stimuli. The currently fielded LW30 mm ammunition requires improvement in insensitive munitions (IM) response without affecting structural and performance requirements. A novel cartridge case design was developed to meet all the system level requirements for LW30 mm ammunition. This design concept can also be implemented in other medium and large caliber munitions.

The primary objective of the present invention is that it meet the standards for an Insensitive Munition, i.e. passing the Fast Cook-Off (FCC)) and Slow Cook-Off (SCO) test requirements of MIL-STD-2105D. Further and significant objectives of the present invention which address the needs detailed above, include providing a means to vent centerfire medium and large caliber cartridges, without any weakness being created in the cartridge structure, without any mechanical device being added to the cartridge, without any significant change to the configuration or mass of the cartridge, and without adding any significant cost to the construction of the cartridge.

Confinement of energetic materials in medium caliber munition is a known aggravator of the reaction violence for gun propulsion systems, since the propellant burn rate varies as a power of the system pressure. Existing M788 and M789, 30 mm×113 mm Lightweight (LW30 mm) rounds are fired from the M230 cannon mounted on the AH-64 Apache and United States Special Operations Command (USSOCOM) Black Hawk helicopters. These munitions use a metal cartridge and are scored a Type-IV Insensitive Munitions (IM) response in Fast Cook-Off (FCO), Bullet Impact (BI), and Fragment Impact (FI) testing and are scored a Type-Ill in Slow Cook-Off (SCO). IM responses are scored by an Army Insensitive Munitions Board (AIMB), resulting in different levels: Type-I/II means Detonation/Partial Detonation; Type-Ill means Explosion; Type-1V means deflagration; Type-V means burning; and Type-VI means No reaction. Ammunition containers for all munitions are required to comply with Insensitive Munitions (IM) requirements set forth in MIL-STD-2105D. Regarding IM testing requirements, two tests may be used to simulate ammunition cartridges exposed to a fire, a slow cook off test (SCO) and a fast cook off test (FCO). In SCO, an ammunition container containing one or more munitions may be heated at a rate of 15 degrees F. per hour, as specified by STANAG 4382, until the munition reacts. In FCO, an ammunition container containing one or more munitions may be engulfed in a flame of at least 800° C. until the munition reacts. It may be desirable for the reaction to be limited to no more than burning (Type-V reaction). A detonation (Type-I reaction) may not be acceptable.

A fixed ammunition is an ammunition in which the cartridge case is permanently attached to the projectile. Such munitions include the LW30 mm, 30 mm×173 mm, 25 mm, 105 mm tank round, 105 mm artillery round, and etc.

BRIEF SUMMARY OF INVENTION

The invention relates to a cartridge ammunition, in particular with a medium-caliber, and in particular to a blank ammunition, comprising a cartridge shell with passages to improve response from unplanned thermal stimuli. The invention approach to comply with IM requirement is to include a venting window or windows within the metal cartridge case and cover those portions with combustible material. Combustible material such as celluloid, foamed celluloid, etc. can be used to cover these proposed venting windows. High pressure and/or temperature produced by munitions in the ammunition container may cause the venting window within the ammunition container to rupture or open, thereby releasing the high pressure gas before the munition in the container undergoes a violent reaction. This will eliminate/reduce confinement and would be a potential solution for reducing the violence of reactions initiated from unintended stimuli such as heat or shock. Compared to redevelopment of non-insensitive munitions (IM) propellant formulations, it is an attractive alternative in terms of cost and schedule effectiveness. Around the top section of the cartridge casing, a combustible material is used to seal the passages within the propellant chamber which accommodates a propellant charge. In a slow cook off or fast cook off scenario a laminate patch such as 105, 385 as shown in the Figures, will allow venting of the round, preventing a rupture. While in practice the combustible material such as nitrocellulose might leave an undesired residue in a launch tube over repeated firings, a sheet of metal foil or other such material is used in the patch over the vent hole facing the gun tube side; such material will not leave any residue. The metal foil or the like will not interfere in the escape of high internal, rupture like, pressures. On its own, foil will not hold significant pressure, including ordinary launch pressures, but the nitrocellulose layer prevents the foil from seeing any such launch pressures in an ordinary launch. In its hardened state, nitrocellulose will withstand ordinary launch pressures.

OBJECTS OF THE INVENTION

Accordingly, it is an object of the present invention to provide an insensitive munition (IM) feature for a lightweight 30 MM ammunition projectile.

Another object of the present invention is to provide combustible vent plugs for a lightweight 30 MM ammunition projectile which will serve to relieve fratricidal explosions during cook off scenarios.

It is a further object of the present invention to provide ammunition vent holes with combustible vent plugs for ammunition to relieve internal round pressure from cook off scenarios.

It is yet another object of the present invention to provide a round with IM reduction means having vents with vent plugs featuring nitrocellulose sheet material fused to metal foil material, the metal foil material used to cover ammunition vent holes from within the round.

It is a still further object of the present invention to provide a round with IM reduction means having vents with combustible vent plugs that are partially (or completely) mounted directly inside the vents.

It is a yet further object of the present invention to provide a round with IM reduction means which can survive both slow cook off (SCO) or fast cook off (FCO) scenarios.

These and other objects, features and advantages of the invention will become more apparent in view of the within detailed descriptions of the invention, the claims, and in light of the following drawings and/or tables wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
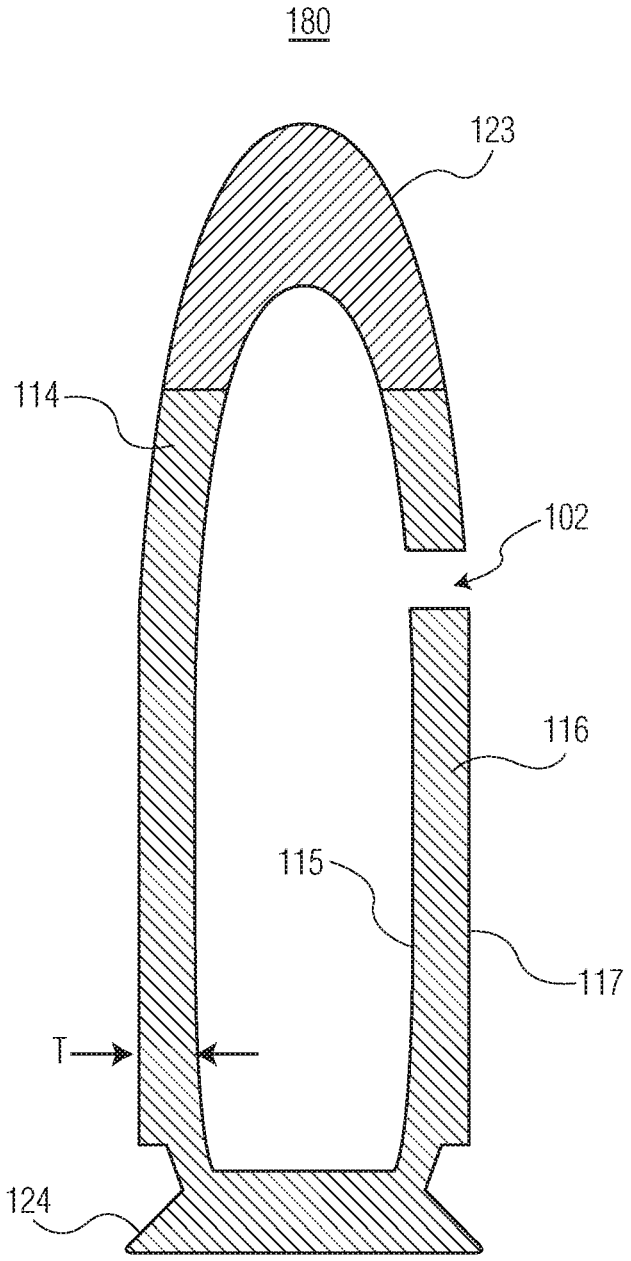
FIG. 1 depicts a cross section of a light weight LW 30 MM ammunition projectile having a vent hole in accordance with this invention.
Figure 2:
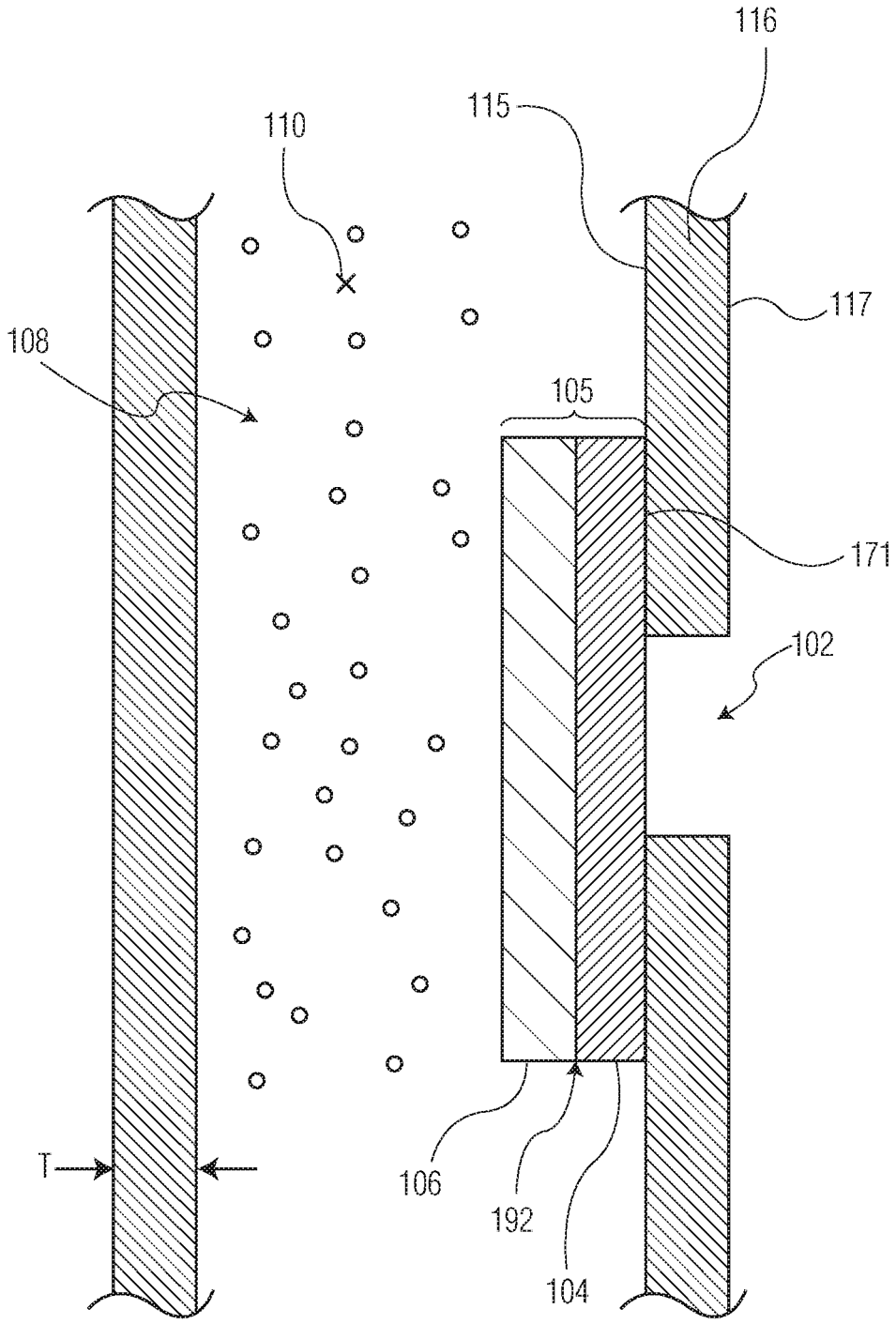
FIG. 2 depicts a vertical cross section of the light weight LW 30 MM ammunition projectile referenced in FIG. 1, having a combustible vent plug system in accordance with this invention.
Figure 3:
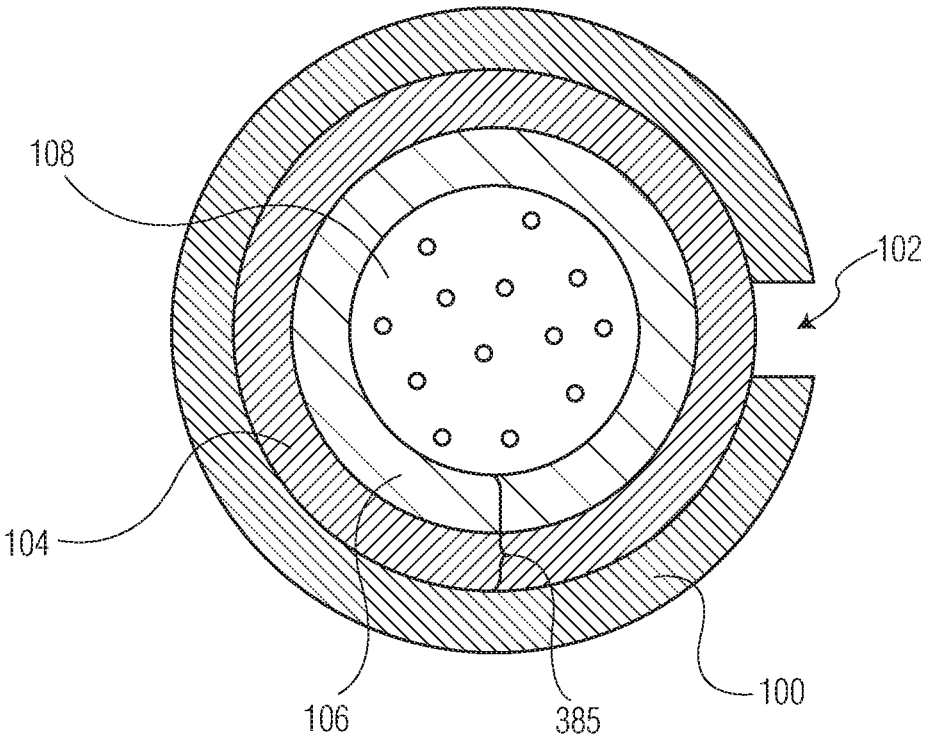
FIG. 3 depicts a horizontal cross section of the light weight LW 30 MM ammunition projectile referenced in FIG. 1, having a ring shaped combustible vent plug system in accordance with this invention.
Figure 4:
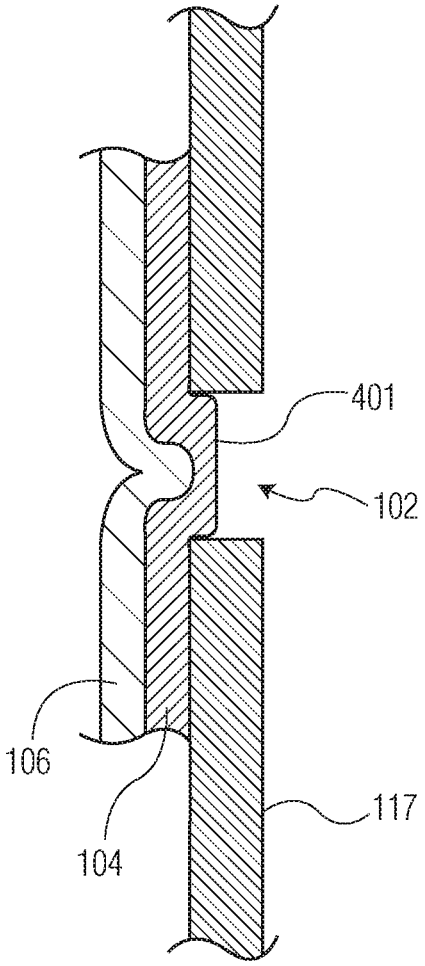
FIG. 4 depicts a vertical cross section of the light weight LW 30 MM ammunition projectile referenced in FIG. 2, having a combustible vent plug system partially inserted into the vent hole 102 in accordance with this invention.
Figure 5:
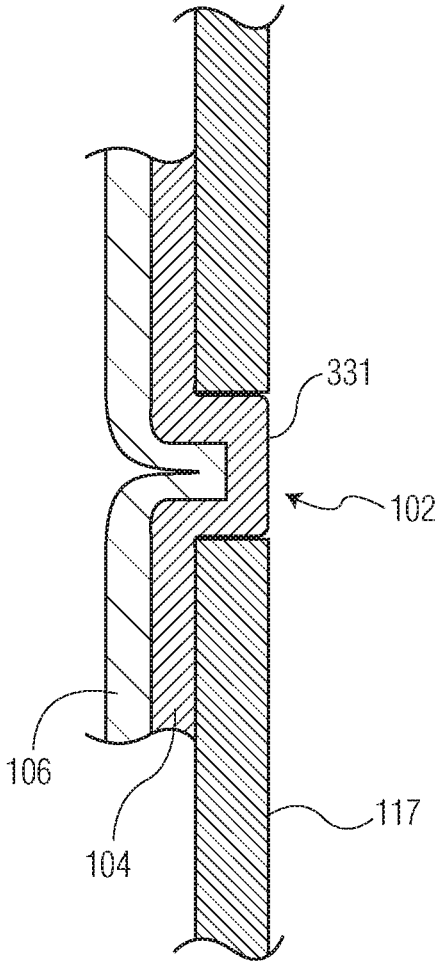
FIG. 5 depicts a vertical cross section of the light weight LW 30 MM ammunition projectile referenced in FIG. 2, having a combustible vent plug system fully inserted into the vent hole 102 in accordance with this invention.
Figure 8:
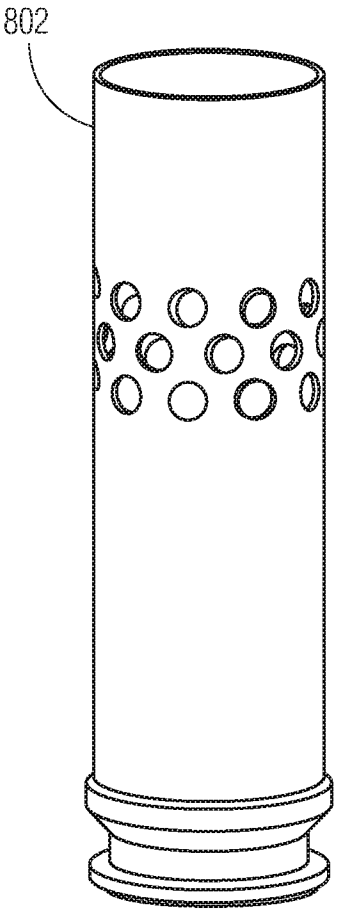
FIG. 8 depicts the light weight LW 30 MM ammunition projectile referenced in FIG. 1 showing multiple 802 circular shaped vent holes in accordance with this invention.
Figure 7:
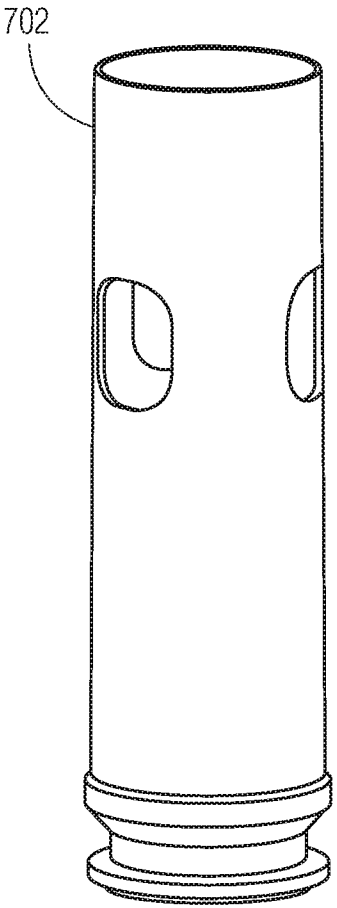
FIG. 7 depicts the light weight LW 30 MM ammunition projectile referenced in FIG. 1 where the cross section of the vent holes comprises an oval 702 shape in accordance with this invention.
Figure 6:
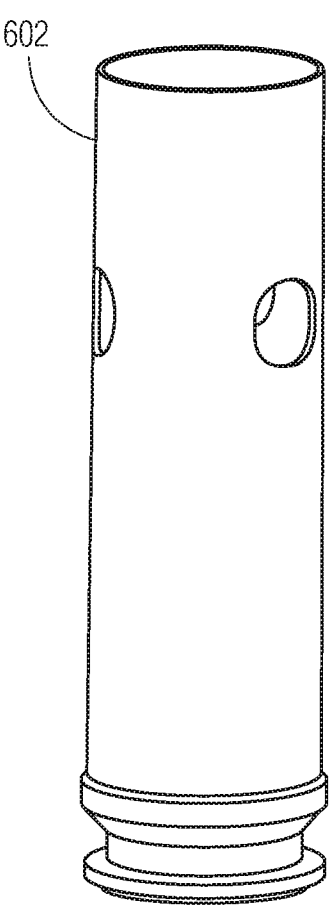
FIG. 6 depicts the light weight LW 30 MM ammunition projectile referenced in FIG. 1 where the cross section of the vent holes comprises a circular shape 602 in accordance with this invention.
Figure 12:
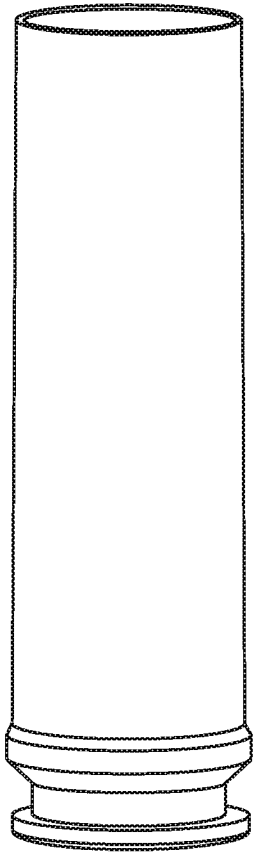
FIG. 12 depicts an uncut cartridge case for the light weight LW 30 MM ammunition projectile referenced in FIG. 1 in accordance with this invention.
Figure 11:
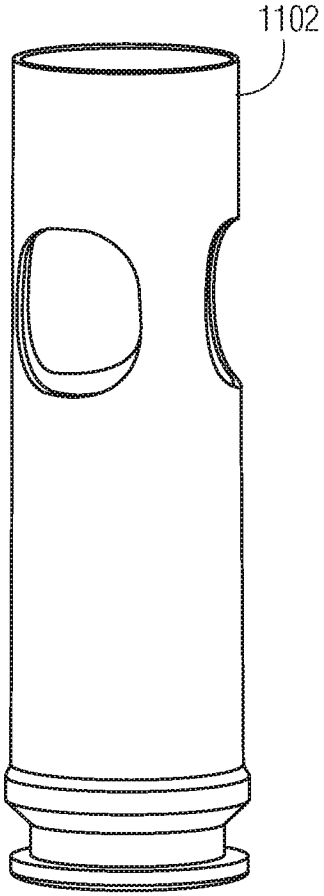
FIG. 11 depicts the light weight LW 30 MM ammunition projectile referenced in FIG. 1 where the cross section of the vent holes comprises an irregular 1102 shape in accordance with this invention.
Figure 10:
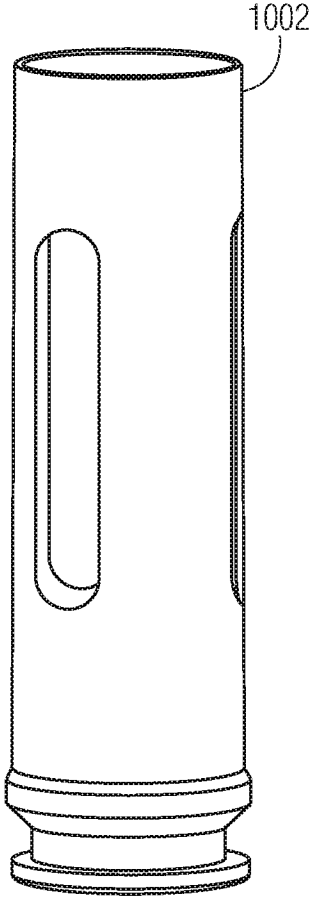
FIG. 10 depicts the light weight LW 30 MM ammunition projectile referenced in FIG. 1 where the cross section of the vent holes comprises a vertical slot 1002 shape in accordance with this invention.
Figure 9:
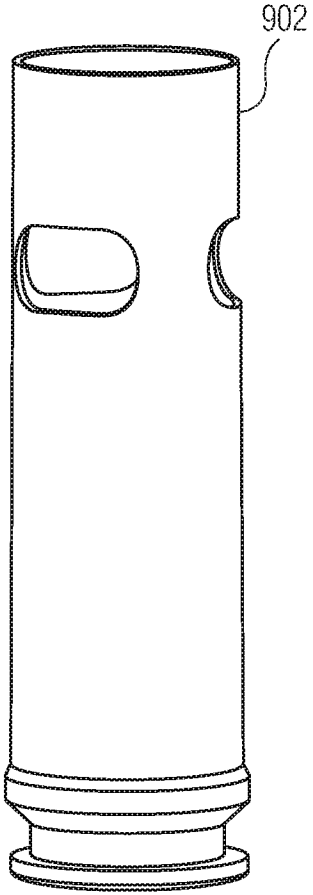
FIG. 9 depicts the light weight LW 30 MM ammunition projectile referenced in FIG. 1 where the cross section of the vent holes comprises a horizontal slot 902 shape in accordance with this invention.

As was mentioned, a primary objective of this invention is to protect an ammunition supply from the effects of unexpected great heat events from slow cook off or fast cook off, which heat can ignite the propellant within one of the rounds. Such ignition would cause great unexpected pressure within the round which leads to a rupture of the round. Such rupture could then take down a large cache of ammunition. This invention provides a design having a vent opening in the side of each round, to allow such high pressures to always escape without a rupture. The next problem is how to seal the vent hole, patching it with some material which would allow for the round to successfully be launched in the ordinary sense. For this purpose, a patch device made of sheet nitrocellulose material is used to seal the round from within. Nitrocellulose, which burns readily, might seem counterintuitive. However, nitrocellulose is a hard substance at lower temperatures prior to launch. It will only soften and melt at the relatively higher temperatures involved seen in slow cook off or fast cook off which could approach perhaps 260 F. In such cook off instances, the vent hole is therefore available to release any high pressures which might have otherwise led to rupture. True, the propellant would then burn (and the nitrocellulose as well), however this is preferable to an explosive incident of a rupturing round which would take down an entire ammunition supply. Thus, nitrocellulose suprisingly is an adequate substance that can be used for these purposes. In an ordinary instance, the nitrocellulose will survive a launch and hold a round intact until it leaves the launch tube. In a slow cook off or fast cook off scenario though, it will allow venting of a round, preventing a rupture. The nitrocellulose has a special quality compared to using some inert material which might have functionally been used to also release pressure and soften when facing cookoff scenarios. Burning nitrocellulose during launch effectively replaces the lost efficiency of diminished volume of propellant that has to be displaced inside the round when including a patch. This cannot be accomplished by using an inert material for the patch. Thus, nitrocellulose is a very special choice for the patch material which has at least the three qualities being sought which are (1) to replace the propellant efficiency because nitrocellulose burns rapidly (even explosively), and (2) to also release pressure and soften when facing cookoff scenarios, and (3) to contain the round pressure in an ordinary launch scenario so the round may be fired in its ordinary fashion, essentially. Burning nitrocellulose however, might leave an undesired residue in the interior of a launch tube over repeated firings. To remedy this problem, a sheet of metal foil or other such functionally equivalent material is used over the vent hole facing the gun tube side for such material will generally not leave any residue. On the plus side, foil or the like will not interfere in the escape of internal rupture pressures such as in cookoff scenarios. On its own, foil can not generally withstand significant pressure, including ordinary launch pressures, but the nitrocellulose layer prevents the foil from seeing any such launch pressures in the ordinary launch. In FIGS. 1-12, a LW 30 MM ammunition projectile 180 having a cartridge case 114, and internal propellant 108 therein is shown. The cartridge case, essentially hollow cylindrical such as in FIG. 12, has defined side walls 116 with a defined inside portion 115 and a defined outside portion 117. It has defined wall thickness T, a rear cap area 124, and eventually connects to a nose area such as 123 which mounts a bullet or other projectile. There are ignition means 110 (shown only symbolically) to initiate the propellant 108 during firing of the round. According to the invention, a combustible vent plug system is shown in FIGS. 2-5 to increase IM properties of the ammunition projectile 180 in cook off scenarios. The combustible vent plug system comprises a through vent hole 102 in the side walls 116 of the cartridge case. A laminated sheet patch 105 covers over the vent hole on the inside portion 115 of the cartridge case being permanently attached there at a surface 171. The laminated sheet patch 105 comprises a layer of material 104 (such as metal foil) adjacent to the inside portion 115 of the cartridge case, and it also features a sheet 106 made exclusively of nitrocellulose material. Sheet 106 is adjacent to the layer of material 104, with sheet 106 and material 104 permanently joined together there at an opposite surface 192 of material 104 from surface 171. Material 104 is of a substance that can withstand ordinary heat temperatures of launch or of cook off scenarios, without, e.g., burning or leaving residues in a launching tube. Material 104 could be made of metal foils, rubbers or elastomers which are soft and have a high heat resistance, or plastic resins which have a high melting point, or combinations thereof. The combustible vent plug system may have more than one vent hole in the cartridge case 114 and for each vent hole there would generally be a separate combustible vent plug system having a laminated sheet patch being permanently attached there on the inside portion 115 of the cartridge case. However, a combustible vent plug system may be formed instead of a laminated ring 385 mounted snugly within a cartridge case 114 and affixed so that laminated ring 385 is attached to and in an air tight manner covers over a vent hole 102 on the inside 115 of the cartridge case. It may have, e.g., a cylindrical layer of material 104 directly adjacent the inside portion 115 of the cartridge case, and also feature a cylindrical layer made exclusively of nitrocellulose material being within the cylindrical layer of material 104, where the both layers are permanently joined together to form the laminated ring 385. A round may have more than one vent hole 802 in the cartridge case 114 and the combustible vent plug system may then take the form of a laminated ring 385 mounted snugly within the cartridge case 114 and affixed so that the laminated ring 385 in air tight manner covers over all the vent holes on the inside 115 of the cartridge case. It would have a cylindrical layer of material 104 directly adjacent the inside portion 115 of the cartridge case, and would also feature a cylindrical layer made exclusively of nitrocellulose material being within the cylindrical layer of material 104, and the both layers are permanently joined together to form the laminated ring 385. A combustible vent plug system according to this invention may be arranged so the laminated patch has a jutting out vent plug 401 partially filling vent hole 102 which seals such vent hole 102 in an air tight manner. In another example, a combustible vent plug system according to this invention may be arranged so the laminated patch has a jutting out vent plug 331 which is all the way through hole 102 and flush to the outside surface 117 of the projectile's wall 116, and which seals such vent hole 102 in an air tight manner. To repeat, the nitrocellulose material 106 can withstand ordinary pressures and temperatures of launch without rupturing, but will soften and fail under the excessive heats of cook off scenarios, thereby in turn to subject material 104 to rupturing under cartridge internal pressures that will build up under cook off scenarios. The patches of the combustible vent plug may be glued into place, or melted into place, bonded or attached by other methods onto surface 171, so they are sealed in place air tight. The metal foil could be attached by bonding to surface 171 on the inside of the cartridge case by, e.g., soldering, brazing, welding or other methods of adhering. The parts of each laminate patch may be glued together, melted together, or otherwise bonded together or otherwise conceivably even by soldering, brazing, welding or other methods of adhering. The vent openings make take many cross sectional forms. Some examples shown are: a circular shape 602, an oval shape 702, multiple vent holes 802, horizontal slot 902, vertical slot 1002, irregular shape 1102. Other possible shapes might conceivably include a rectangle, a star, a diamond, or of some other shape. The venting window on the cartridge must meet the following munition requirements: (1) Match or surpass all conditions during the sequential safety testing (SST) in a packaged ammunition container. (2) The ammunition should match or surpass the bullet-pull force, when compared to the tactical round. (3) The cartridge case should also seal all the combustion gases from those passages/vents during the ballistic test firing event, (4) The cartridge case should match or surpass the total amount of propellant charge compared to the tactical round. (5) The case should also match or surpass the velocity requirement within the munition pressure limit, across extreme temperatures. (6) The ammunition should match or surpass the auto-handling system during the ballistic cycle. The proposed invention is demonstrated on an M788, LW30 mm system as an example. For the LW30 mm cartridge, venting windows were created across the length of the cartridge with preferred location to be in the top ⅓ portion of the cartridge to meet all the current requirements in addition to improve the IM response. To seal the combustion gases during a ballistic firing event, the venting windows covering combustible material had to be in the top ⅓ region of the cartridge. The bullet-pull (or bullet-extraction) force requirement for M788 round specifies that mean less three sigma should be greater than 1800 lbf. In other words, $\mu-3\sigma>8$ kN (1800 lbf). But, the tactical rounds separate at around ~3000 lbf. All the proposed venting design concepts surpass the munition requirements and matches, in accordance with tactical rounds. It would not matter if the vents were covered with a combustible material. The following examples are novel methods to cover the vent holes:

Example 1: Laminated Combustible Vent Plug

The laminated combustible vent plug consists of two layers, one of which is a material which can withstand the high temperatures found inside of a barrel or firing chamber but by itself is unable to contain any pressure, and a secondary material which is able to contain pressure during normal storage and handling environments but which becomes compromised during high temperature environments.

This plug provides the following benefits. A layer of material is located within the vent hole of a munitions container. The material is on its own so thin or weak that it is unable to retain pressure. As a consequence, it is likely unable to withstand the forces of routine handling. However, the material needs to be able to withstand the high temperatures found within a barrel or firing chamber and be chemically compatible with any chemicals that a munition is expected to come in contact with. The combustible material may consist of or include in its make up nitro cellulose, celluloid or propellant which soften at elevated temperatures. At these elevated temperatures, the material loses its strength and is unable to retain pressures which may exacerbate an undesirable reaction. Because the vent plug occupies volume which displaces propulsive material, the addition of combustible material mitigates the loss to maintain the performance of the munition. The combustible material on its own may be prone to leaving residue in a gun chamber. The layer of a material between the combustible material and the gun chamber prevents the buildup of residue. The combustible material could <melt and adhere to a hot gun chamber. The layer of a material between the combustible material and the gun chamber prevents the combustible material from sticking to the gun chamber. The two layers working together provide benefits which cannot be achieved by a single material alone. It can withstand the forces of rough handling; it can withstand exposer to chemicals or harsh environments; it can withstand exposure to a hot firing chamber; it prevents the buildup of residue in the firing chamber; and it is capable of providing venting when heated. The fabrication of a laminated combustible vent plug may be achieved in a variety of ways. One preferred method is the following. Using a two part die, stamp a sheet of metal foil so that the foil takes on a shape that will conform to three features: the inside surface of a munitions container, the hole in the munitions container that the plug needs to fill, and the outside surface of the munitions container which would sit flush against the firing chamber when loaded. The foil may be placed in the same female die, or a different fixture entirely which provides support to the convex side of the foil. A sheet of celluloid is heated to above its glass transition temperature before being placed on the concave side of the foil. Another die is pressed to force the celluloid to conform to the geometry of the foil. An adhesive could be applied before the celluloid is pressed or after in order to join the foil to the celluloid. The laminated combustible plug, now formed, is inserted into the vent hole with additional adhesive. Alternative materials for the additional layer include any metal foils, rubbers or elastomers which are soft and have a high heat resistance, and plastic resins which have a high melting point.

Example 2: Hybrid Concept of Inert and Combustible Material Together

The following steps were taken to cover the venting windows using a hybrid concept, with a combination of an inert and combustible material. In this example, celluloid sheet was used as a combustible material. The following process covers the vent hole, but covers the entire vent location, making it flush from the outside of the cartridge. Identify the proper location on the cartridge case. Drill through the cartridge, from one side to another making it symmetric using the specific drill size. Smooth the edges of the cut metal. A solvent-wet celluloid mixture was prepared by mixing industrial grade (<12% nitrogen content), camphor, stabilizer, and Part A (resin) epoxy in acetone+ethyl alcohol solvent. The mixture was spread in a mold to remove solvent to form a film/sheet of roughly 0.2 mm in thickness. An inert material such as polycarbonate (or Radel R-5000, etc.), non-combustible material, of 0.2 mm in sheet thickness was pre-cut to desired dimensions. A thin layer was Part B (hardener) was applied on an inert sheet. Dry, celluloid sheets were bonded on to the hardener substrate, allowing the combustible material to cure. Samples, are kept at 75° C. to cure faster. The samples are not physically too long to interfere with the projectile end, which gets inserted and crimped into the cartridge round. These prepared hybrid sample sheets are bonded on the inside of the cartridge, covering the vent holes through the opening of the cartridge mouth. Apply some pressure of about 5 psi (or 1 lb) for about ~5 mins onto the contact surface where the sheet is bonded on the cartridge to verify the seal. The total thickness of the prototype is about 0.4 mm. After 5 minutes, the cartridge including passages are covered with the hybrid material. The sheet sample can be flush to match the outer dimension (OD) of the cartridge. It doesn't necessarily have to be. Using this prototype, both materials will soften under a SCO (Slow cook-off) IM environment and vent the passages. The testing has demonstrated that venting happens at 290 F (143° C.) after ~8 hours. The softening temperature of celluloid is around 90° C., whereas the polycarbonate is 147° C. During SCO, softening of celluloid material from inside the cartridge accelerates thermal softening of the epoxy and polycarbonate material. While during ballistics the action time is within ~2 ms, where the celluloid, combustible material will burn through leaving the non-combustible material intact with metal to seal the combustion gases. If the polycarbonate substrate is not flush from the design, the celluloid material will consume quickly and push (or through inertia move) the polycarbonate material into the window region to match the OD of the cartridge. However, the non-combustible material will not consume and securely seal the combustion gases. An inert sample could be a braided sleeve/sheet with part A epoxy coated as a binder, so venting initiates through the space between the braided sections and can accelerate the IM response time to be faster than ~8 hours.

Example 3: Methods to Make the Venting Windows and Cover Using Combustible Materials The following steps were taken to cover the venting windows using a combustible material. In this example, celluloid sheet was used as a combustible material. The following process covers the vent hole, but does not cover the entire vent location, not making it flush from the outside of the cartridge. Identify the proper location on the cartridge case. Drill through the cartridge, from one side to another making it symmetric using the specific drill size. Smooth the edges of the cut metal. Celluloid sheet of known thickness and length was precisely cut into square dimensions; not too long that the sheet interferes with the projectile end, which gets inserted and crimped into the cartridge round. A known amount of Krazy-glue or adhesive or epoxy was used on one side of each square cut-away. The glue side of each celluloid sample is bonded on the inside of the cartridge, covering the vent holes through the opening of the cartridge mouth. Apply some pressure of about 5 lbs for about ~5 mins onto the contact surface where the sheet is bonded on the cartridge to verify the seal. After 5 minutes, the cartridge including passages, covered with combustible celluloid sheet material is complete.

Example 4

The following steps were also taken to cover the venting windows using a combustible material. In this example, celluloid sheet was used as a combustible material. The following process covers the entire vent hole location, making it flush from the outside of the cartridge. Identify the proper location on the cartridge case. Drill through the cartridge, from one side to another making it symmetric using the specific drill size. Smooth the edges of the cut metal. Celluloid tube of known thickness and length is pre-made to fit directly inside the cartridge through the opening of the cartridge mouth. Celluloid tube is aligned properly covering those vent locations. A blow-molding technique is used in this process to cover the venting windows by celluloid tube. An aluminum mold, split into two halves matching the outer dimension of the metal cartridges, surrounds the vent holes. A flexible rubber gasket/tube is clamped on to the mandrel piece with an air passage at its top. The mandrel and air passage is connected to compressed air with pressure and flow control. Thus, proper air pressure can be applied to the inner side of the rubber tube and push the celluloid sheet to conform to the inner wall of the split half mold. Insert the celluloid tube inside the LW30 mm metal, vented cartridge. Insert the rubber tube with the mandrel inside the cartridge, around the celluloid tube piece. The rubber tube has a smaller diameter when not expanded, in a way that it can be inserted inside the celluloid tube before molding and taken out after that. Use split half mold to cover the vented locations, conforming the outer dimensions of the cartridge. Merge the assembled mold with mandrel and celluloid tube into water bath of elevated temperature for about ~30 seconds. Apply 20 to 25 PSI of air pressure to the rubber tube to let the softened celluloid tube expand. Hold the pressure and keep the mold in hot water for about ~1 minute. Move the mold out of the water bath and merge into another container of cooling water at room temperature for about ~3 minutes. Once the mold has cooled down, release the air pressure and take the mandrel with rubber tube out. Move the mold out of the water and open it to collect the molded product.

While the invention may have been described with reference to certain embodiments, numerous changes, alterations and modifications to the described embodiments are possible without departing from the spirit and scope of the invention as defined in the appended claims, and equivalents thereof.

What is claimed is:

1. In a Lightweight 30 Millimeter ammunition projectile (180) having a cartridge case (114), and internal propellant (108) therein, said cartridge case further having side walls (116) and having a defined inside portion (115) and outside portion (117) of the cartridge case:

a combustible vent plug system to increase insensitive munition properties of the ammunition projectile (180) in cook off scenarios, wherein the combustible vent plug system comprises a through vent hole (102) in the side walls (116) of the cartridge case, and wherein a laminated sheet patch (105) covers over the vent hole on the inside portion (115) of the cartridge case being permanently attached there at a surface (171), and wherein the laminated sheet patch (105) comprises a layer of material (104) adjacent the inside portion (115) of the cartridge case, and wherein the laminated sheet patch (105) also features a sheet (106) made exclusively of nitrocellulose material, said sheet (106) being adjacent to the said layer of material (104), and where the material (104) is of metal foil, with the sheet (106) and the material (104) permanently joined together there at an opposite surface (192) of the material (104) from the surface (171).

2. The combustible vent plug system of claim 1 wherein said material (104) is of a substance that can withstand ordinary heat temperatures of launch or of cook off scenarios, without burning or leaving residues.

3. The combustible vent plug system of claim 1 where the laminated patch has a jutting out vent plug (401) partially filling the vent hole (102) which seals the said vent hold (102) in an airtight manner.

4. The combustible vent plug system of claim 1 where the laminated patch has a jutting out vent plug (531) all the way through the vent hole (102) and flush to the outside surface (117) of the projectile's wall (116), and which seals the said vent hole (102) in an airtight manner.

* * * * *